United States Patent [19]

Basse

[11] 4,128,747

[45] Dec. 5, 1978

[54] HINGE FOR A PIVOTABLE ARM OF AN ELECTRIC SNAP SWITCH

[75] Inventor: Tage S. Basse, Nordborg, Denmark

[73] Assignee: Danfoss A/S, Nordborg, Denmark

[21] Appl. No.: 715,149

[22] Filed: Aug. 17, 1976

[30] Foreign Application Priority Data

Aug. 16, 1975 [DE] Fed. Rep. of Germany ..... 2536554

[51] Int. Cl.[2] ..... H01H 21/44

[52] U.S. Cl. ..... 200/67 D; 200/83 S

[58] Field of Search ..... 200/83 SA, 83 S, 83 P, 200/67 D, 83 C, 330; 340/229

[56] References Cited

U.S. PATENT DOCUMENTS

| | | | |
|---|---|---|---|
| 2,738,397 | 3/1956 | Slonneger | 200/83 P |
| 3,182,149 | 5/1965 | Noakes | 200/83 S |
| 3,764,763 | 10/1973 | Barnes | 200/83 SA |

*Primary Examiner*—Samuel W. Engle
*Assistant Examiner*—Ralph Palo
*Attorney, Agent, or Firm*—Wayne B. Easton

[57] ABSTRACT

The invention relates to an electric snap switch assembly which includes a stiff arm which is pivotal about a fixed axis abutment and is movable in a range between two operative positions. A sheet metal hinge member extends the length of the arm and is attached to the fixed axis abutment and to the arm. A sheet metal spacer member is attached to a movable abutment and a U-shaped bow spring straddling the movable abutment is maintained in a compressive state with one leg thereof attached to the free end of the hinge member and the other leg thereof attached to the movable abutment member. A pivotally mounted adjustment member carries the movable abutment.

3 Claims, 4 Drawing Figures

HINGE FOR A PIVOTABLE ARM OF AN ELECTRIC SNAP SWITCH

The invention relates to a hinge for a pivotable arm of an electric snap switch, comprising a counterbearing and a bearing against which the counterbearing bears under the action of the force of a spring, the counterbearing being a bent sheet metal member which embraces the bearing under this force and which is secured to the bearing and the member pivotable with respect thereto.

The parent patent is based on a hinge for a pivotable arm of an electric snap switch, comprising a counterbearing provided on the arm and a bearing against which the counterbearing bears under the action of a force applied to the arm, and it protects the feature that the counterbearing is a bent sheet metal member which embraces the bearing under the action of this force and which is secured to the arm and to the bearing, in each case at a spacing from the pivotal axis of the arm. By means of this construction it is possible to provide a hinge with comparatively little and practically constant friction. Consequently, frictional forces only play a minor role in the switching behaviour. This increases the accuracy of response. Further, the switching difference can be kept small.

To produce the force stressing the counterbearing sheet metal member, use is made, inter alia, of the springs that are in any case provided in a snap switch, such as the snap spring, desired value spring or differential spring. In the practical embodiment, these springs engage a stiff pivotable arm by way of hinges.

The invention is based on the object of forming such a spring hinge with little friction and in a constructionally simple manner.

This object is achieved according to the invention in that the pivotable arm is formed by a spring element having its end provided with a securing surface to which the counterbearing sheet metal member is secured.

In this construction, a spring element is used as pivotable arm in the same sense as in the parent patent and the spring hinge is produced with the aid of a counterbearing sheet metal member. For this purpose it is merely necessary to provide at the spring element a securing surface to which the counterbearing sheet metal member can be secured. In other respects, the advantages of little friction are retained for such a hinge. It is also favourable that the force from the spring element acts directly on the counterbearing sheet metal member and thereby exerts the necessary stress on this sheet metal member.

The bearing can be carried either by the spring element, particularly if the latter is under compression, or by the member pivotable with respect thereto, particularly if the spring element is under tension.

In a preferred embodiment, the spring element consists of bent spring strip. In this case the surface of the strip at the end of the spring can be used directly as the securing surface for the counterbearing sheet metal member. It is therefore not necessary to provide the spring element with an additional member which exhibits the securing surface.

In particular, the spring element can be formed from a bow spring of spring strip which is pivotably mounted at both sides by way of counterbearing sheet metal members. Such a bow spring can exert either compressional or tensional stresses. If the hinges are made with the aid of counterbearing sheet metal members at both sides, one obtains a particularly low-friction construction. Since the surfaces of the strip at both ends can be used directly as securing surfaces, one achieves a particularly simple construction. The expression 'bow spring' is intended to embrace springs having a bow, e.g. U springs or omega springs and springs with two or more bows behind one another, e.g. meander springs.

In particular, both ends of a spring strip bow spring that is under compression can be in the form of bearings. Suitable bearings are obtained simply by cutting off or bending over the spring strip.

A further simplification of the hinge is obtained in that it is formed between the spring element and a stiff arm and its counterbearing is formed by a sheet metal member which extends along the stiff arm and also forms the counterbearing for a second hinge between the stiff arm and a further bearing. In this case a single sheet metal member with a single securing point on the stiff arm can be utilised for a spring hinge and a further hinge.

In an advantageous embodiment, provision is made for the spring element to carry the bearing, for the member pivotable with respect thereto to be provided with an additional bearing between said bearing and the securing point for the counterbearing sheet metal member, and for the counterbearing sheet metal member to be freely clamped between the bearing and additional bearing.

In this way the spring force and the counterbearing sheet metal member are utilised to produce a double hinge in which the pivotal motion is divided between the bearing and additional bearing and an additional translatory movement is produced that tends to support the snap action.

If the bow spring overlaps a stiff arm which is pivotable about a fixed pivotal axis and the additional bearing is stationary and disposed between the spring ends, one obtains a short structural length for the snap switch by utilising the fact that the important components overlap one another and the hinges require practically no additional space. In particular, the bow spring can simultaneously serve as the snap spring and main spring.

Further, the additional bearing may be seated at a setting element which is pivotable about a shaft in the vicinity of the hinge between the bow spring and stiff arm. By pivoting the setting element, the snap characteristics can be altered.

The invention will now be described in more detail with reference to the example shown in the drawing, wherein.

Figure 1:
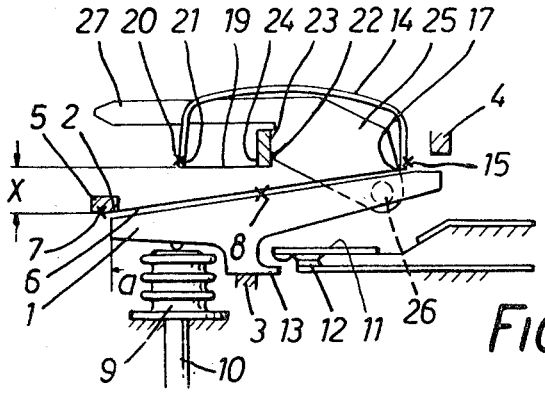
FIG. 1 is the diagrammatic representation of a snap switch with a hinge according to the invention.

The snap switch of FIG. 1 comprises a stiff arm 1 which is pivotable about a pivotal axis 2 between two operative positions limited by abutments 3 and 4 which may be adjustable and that are fixed with respect to the housing. The pivotal axis 2 which is a fixed axis abutment, is formed by the edge of a bearing 5. A thin sheet metal hinge member 6 in strip form serves as a counterbearing and is secured to the bearing 5 at the point 7 and to the stiff arm 1 at the point 8, e.g. by welding.

Figure 3:
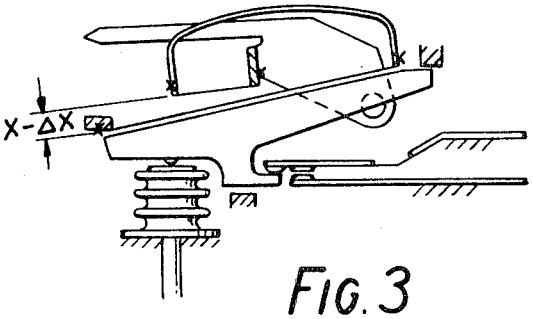
FIG. 3 shows the FIG. 1 snap switch in the other snap condition.

Acting on the stiff arm 1 there is the force of an operating element 9 which is under pressure and which is connected through a capillary tube 10 to a pressure source, e.g. a temperature senser filled with fluid/-vapour. In the position shown in FIG. 1, a prestressed movable contact 11 lies on a fixed contact 12. A catch 13 tends to lift the movable contact 11 from the fixed contact 12 in the other snap position which is shown in FIG. 3. The switch is indicated only diagrammatically. Instead of the rest contact, it may also comprise an operating contact or be a reversing switch.

Figure 2:
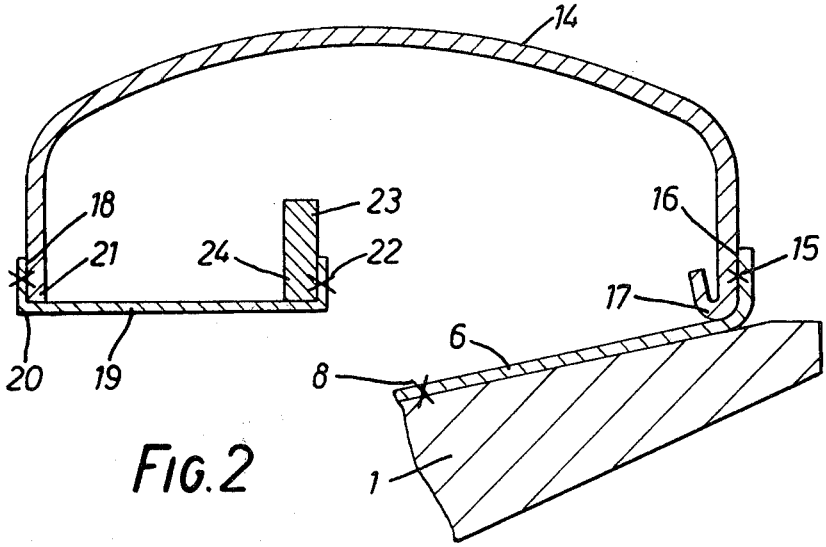
FIG. 2 is an enlarged representation of the bow spring that is used and of the adjoining hinges.

A bow spring 14 consisting of spring strip serves as the snap and main spring. The counterbearing sheet metal member 6 is guided over the entire length of the stiff arm 1 and secured at 15, for example by welding, to a securing surface 16 formed by the surface of the spring strip. The adjacent edge, which may be rounded as shown in FIG. 2, forms a bearing 17 which defines a pivotal axis between the spring bow 14 and stiff arm 1. The spring bow is under compression and therefore exerts a tensile force on the counterbearing sheet metal member 6. This sheet metal member is pulled under such tension over the edge 2 as well as over the bearing 17.

The other end of the spring bow 14 comprises a similar securing surface 18 to which a second counterbearing sheet metal spacer member 19 is secured at the point 20 such as by welding. The bearing 21 is defined by the underside of the left-hand end of the spring bow 14 over which the strip-shaped counterbearing sheet metal spacer member 19 is stressed under the compressive force of the spring 14. The other end of the sheet metal member 19 is secured such as by welding to a point 22 of a further bearing 23 which in effect is a movable or adjustable abutment member. Here, the underside 24 of the bearing serves as pivotal axis. If the bearing 21 or the underside 24 is not rounded, one of the side edges of the bearing or of the underside serves as the pivotal axis. Since these side edges can alternate during the snap action, additional effects are obtained.

In the position of FIG. 1, the bow spring 14 straddles the movable abutment 23 and acts on the stiff arm 1 by way of a lever arm x with a force corresponding to its compressive stress. The force of the operating element 9 acts by way of a lever arm a. When the last-mentioned torque exceeds the first-mentioned torque, the switch snaps over into the position shown in FIG. 3. In this position, it is not only the right-hand end of the bow spring 14 that is carried upwardly. Instead, the left-hand end of the bow spring 14 also assumes a new position by reason of the translatory freedom of the double hinge formed by the pivotal axes 21 and 24. In this position, the lever arm has been reduced by the amount $\Delta x$, i.e. it now only has the value $x - \Delta x$. Consequently the switch returns to the rest position only when the force of the operating element 9 has fallen below a corresponding smaller value. The bow spring 14 serves as main spring because its force is decisive for the torque which has to be overcome with the aid of the force of the operating element. It also serves as the snap spring because its displacement is also decisive for the difference of the switch. Finally, it produces the tension in both counterbearing sheet metal members 6 and 19 with the aid of which the latter are stressed over the associated bearing edges.

Figure 4:
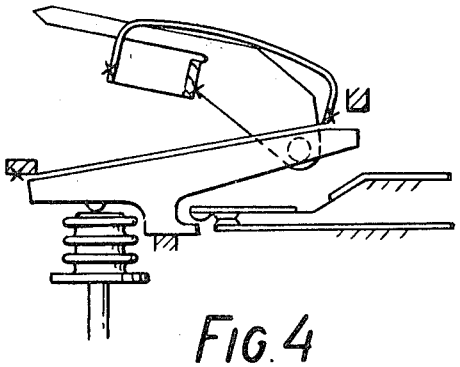
FIG. 4 shows the FIG. 1 snap switch with pivoted setting element.

The bearing 23 is part of a setting element 25 which is pivotable about a shaft 26. This shaft is located in the vicinity of the hinge between the stiff arm 1 and spring bow 14 but is not coincident therewith. A lever 27, which also serves as a pointer, permits pivotal displacement of the setting element in the manner shown in FIG. 4. It will be evident that in this way the stress of the bow spring 14 can be changed so that the snap switch responds at a different value of the force of the operating element 9.

The principle of the invention can also be applied to different springs used in snap switches, even if these do not form a snap arm but merely engage the stiff arm by way of a hinge. This includes for example the conventional desired value spring if the snap spring and desired value spring are separate from one another. The springs can also be in the form of tension springs, in which case it is recommended not to provide the associated bearings at the spring element but at the member pivotable with respect thereto. If the spring element is not made of spring strip but for example of spring wire, the end of this wire can be rigidly joined to a securing element at which the securing surface is then formed.

I claim:

1. An electric snap switch assembly comprising, a stiff arm pivotal about a fixed axis abutment and being movable in a range between two operative positions, a sheet metal hinge member extending the length of said arm and being attached to said abutment and to said arm, a movable abutment, a sheet metal spacer member attached to said movable abutment, a U-shaped bow spring straddling said movable abutment and being maintained in a compressive state with one leg thereof attached to the free end of said hinge member and the other leg thereof attached to said movable abutment member.

2. An electric snap switch assembly according to claim 1 including a pivotally mounted adjustment member, said movable abutment being mounted on said adjustment member.

3. An electric snap switch assembly according to claim 1 wherein said bow spring is a formed steel strip.

* * * * *